United States Patent [19]

Salomon

[11] 3,960,384

[45] June 1, 1976

[54] METHOD FOR PROVIDING RECOIL IN A SAFETY BINDING FOR SKIS AND DEVICE FOR THE SAME

[75] Inventor: Georges Pierre Joseph Salomon, Annecy, France

[73] Assignee: Etablissements Francois Salomon et Fils, Annecy, France

[22] Filed: Mar. 6, 1975

[21] Appl. No.: 555,865

[30] Foreign Application Priority Data

Mar. 8, 1974 France ..... 74.07967

[52] U.S. Cl. ..... 280/623; 280/634

[51] Int. Cl.[2] ..... A63C 9/08

[58] Field of Search ..... 280/11.35 T

[56] References Cited

UNITED STATES PATENTS

| | | | |
|---|---|---|---|
| 3,408,087 | 10/1968 | Ramillon | 280/11.35 T |
| 3,620,545 | 11/1971 | Korger | 280/11.35 T |
| 3,801,121 | 4/1974 | Mimeur | 280/11.35 T |
| 3,830,510 | 8/1974 | Stauffer | 280/11.35 T |

*Primary Examiner*—Robert R. Song

[57] ABSTRACT

The invention relates to a method and a device for providing resilient recoil in a binding in response to the stresses arising during skiing. The device comprises at least two springs arranged in series in a housing on baseplate on which a binding is mounted. A rod runs along the axis of the springs, and a head of the rod takes the thrust from the binding; one spring bears against the baseplate and a stop separates the two springs. This system acts to absorb stresses not intended to affect the release mechanism.

15 Claims, 5 Drawing Figures

METHOD FOR PROVIDING RECOIL IN A SAFETY BINDING FOR SKIS AND DEVICE FOR THE SAME

The present invention relates in the first place to a method for providing relative movement of at least one of the elements of a binding, i.e. the front stop or the heel-piece, in relation to the other and to the ski; the invention also relates to a device for the execution of this method.

A device of this kind is usually known as a recoil device, since it comes into action mainly to allow a certain amount of variation in the distance between the stop and the heel-piece during skiing.

The distance between the stop and the heel-piece is known to be adapted to the length of the ski boot by adjusting one or possibly both of these elements in the longitudinal direction of the ski.

This adjustment must be such that when the skier is at rest, the stop and the heel-piece grip the sole of the boot with a predetermined force. During a run, however, the ski is subjected to certain stresses arising from irregularities in the surface of the snow. Provision must therefore be made to permit resilient displacement of at least one of the elements of the binding on each side of the position to which it is initially adjusted, so that stresses produced by the bending of the ski between two humps may be absorbed without detriment to the ski, since, in cases of this kind, the ski curves to such an extent that the distance between the heel-piece and the stop has a tendency to decrease. Were the stop and heel-piece to be immovable, this would result in:

considerable parasitic stresses on the ski leading, for instance, to the screws securing the binding to the ski being torn out;

or in pressures on the ski boot which could lead to inadvertent release of the binding, or to damage thereto.

Devices permitting resilient displacement of the elements of the binding have already been proposed for the purpose of absorbing these parasitic stresses. These devices generally consist of springs preferably distinct from those of the locking system, in order that the vertical release load, in the event of a fall, may be independent of the position of the binding. These springs are generally known as recoil springs.

This independence of the recoil springs promotes satisfactory operation of the heel-piece, especially since the latter is usually the one to be resiliently displaced. However, an arrangement of this kind cannot be applied to a front stop which is sensitive to thrust, for example, to a stop in the form of a simple pivot.

When a ski is fitted with a stop of this kind, and if the ski flexes between two humps, the load required for a lateral release becomes such that the skier's safety is endangered.

It might be thought that this could be overcome by using highly sensitive recoil springs which would allow resilient displacement at relatively low loads, but this would lead to difficulties of another kind, more particularly unwanted release during manoeuvres such as a change of direction, all the more so in the case of recoil springs with long travel.

Now experience has shown that, for reasons of safety, it is necessary to provide relatively significant resilient displacements of the binding, and therefore recoil springs having long travels, with, among other advantages, the possibility of using a notched length adjustment, i.e. a discontinuous adjustment system.

There are, in fact, many adjustment systems which permit very fine adjustment. These are known as continuous adjustment systems and may be used with short-travel recoil springs. It has been found, however, that this type of adjustment is not used most of the time, since skiers may transpose their left and right skis, and the length of soles made in different moulds is not the same; or they may loan their skis without altering the adjustment, as long as the ski can be put on.

There is thus no doubt as to the need to be able to displace bindings significantly without altering the adjustment of the safety-release loads.

It is also pointed out that continuous-adjustment systems are more troublesome and less practical.

The present invention proposes a method and a device which will solve the problems mentioned above and will make it possible to use stops sensitive to thrust and having long recoil travels.

According to the invention, the method for providing relative displacement of the stop and heel-piece elements of a binding in relation to each other and to the ski upon which they are mounted, for the purpose of absorbing parasitic stresses acting upon the binding, without bringing about a safety release or altering the characteristics thereof, is characterized in that:

provision is made for a first resilient displacement of at least one of the elements of the binding, for a first series of load values;

the elements of the binding are temporarily immobilized in the position they occupy after the first displacement, for a second series of load values higher than the first series; and provision is made for a second resilient displacement of at least one of the elements of the binding, for a third series of load values higher than the second series.

The device for the execution of the above method is characterized in that it comprises at least two resilient elements arranged in series between a part which is fixed, at least temporarily, in relation to the ski, and a part integral with the binding, and which acts consecutively, at least the second part which comes into action being prestressed.

The first resilient element is actuated by an initial phase of displacement of the binding, the second resilient element relaying the first and being actuated during a second phase of displacement of the binding. The two resilient elements are preferably compression springs, and they are arranged more or less parallel with the longitudinal direction of the ski, along a common axis.

The springs may have different mechanical characteristics, in which case the first spring will be weaker than the second and will allow the binding to be displaced in response to relatively minor loads.

It is also possible, however, to use two identical springs. In this case, however, it is desirable for the second spring to be kept, in the absence of the boot, in a precompressed condition greater than that of the first spring.

It is moreover to be understood, in a general way, that if the springs have different mechanical characteristics, they might also be precompressed, the prestress applied to the second spring always being greater than that applied to the first.

In other words, it is desirable that, under the action of a load tending to separate the elements of the binding, during an initial period only the first spring shall be compressed, and that then, beyond a certain load, the second spring shall take over and allow additional displacement of the element of the binding.

It is to be understood that it would be possible:

either to place the two springs end-to-end, so that both cooperate with only one of the two elements constituting the binding, more particularly the heel-piece;

or to make one of the springs cooperate with the front stop and the other with the heel-piece.

A description will now be given, by way of nonrestrictive examples, of two forms of execution of the invention, with reference to the drawings attached hereto, wherein.

Figure 1:
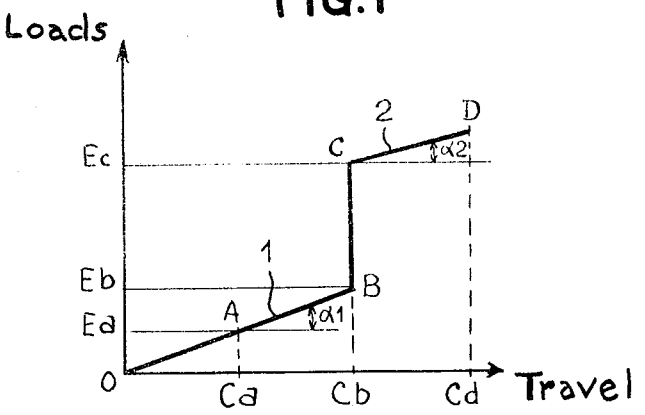
FIG. 1 is a graph indicating the operation of the device according to the invention.

The graph in FIG. 1 indicates the operation of the device according to the invention, making it possible to determine the amount of the resilient recoil of a binding in relation to the loads applied thereto.

The distance travelled by the binding is shown on the abscissa and the loads opposing this travel are shown on the ordinate, disregarding any side effects such as friction, etc.

Line 1 defining points A and B represents the travel of the binding permitted by compression of the first spring, whereas line 2 defining points C and D represents the travel of the binding permitted by compression of the second spring.

As may be seen in the graph, compression of the second spring begins only as the result of a load *c* greater than the load *b* which caused compression of the first spring.

In other words, the second spring takes over from the first only beyond load *c*.

This characteristic arises mainly from the fact that the second spring is precompressed and can be activated only beyond a certain threshold.

As regards the first spring, in the normal position of the binding this may be in the completely expanded state, and the travel it would allow is that indicated by segment OB.

However, the first spring might also be precompressed, in which case compression thereof would cause the binding to travel only from point *a* onwards.

It will furthermore be understood that angles $\alpha 1$ and $\alpha 2$ which, of necessity, will always be greater than or equal to 0, may be identical or different.

A description will now be given of the form of execution illustrated in FIGS. 2, 3 and 4.

Figure 2:
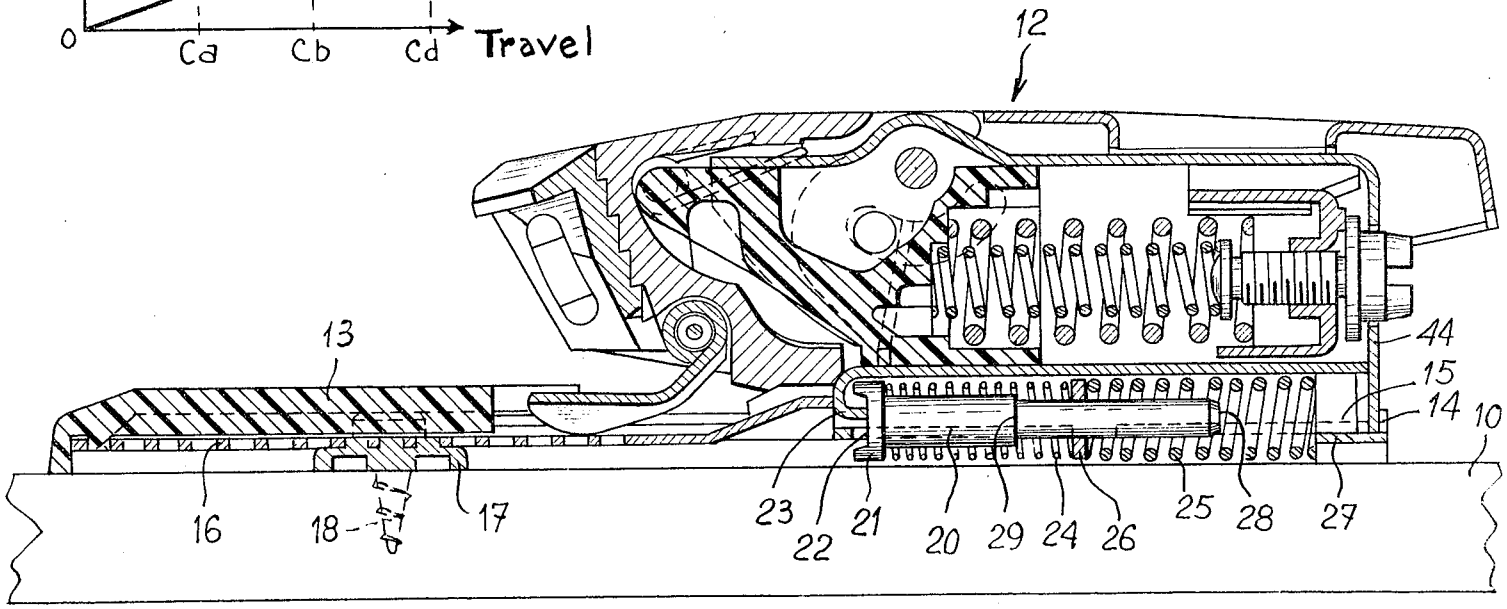
FIG. 2 is a sectional view of a first form of execution of the device according to the invention.

In FIG. 2, 10 is a ski to which are attached a front stop, not shown, and a heel-piece 12, the latter being arranged to slide on a baseplate 13 fitted with slides 14 with which are engaged wings 15 of the body of the heel-piece. The latter, which is conventional and will not be described in detail, comprises a jaw subjected to the action of a locking piston associated with a locking spring which provides for safety releases.

The front part of baseplate 13 is provided with an adjustment system having notches 16 cooperating with teeth on a bar 17 secured to the ski by means of two screws 18.

This is a discontinuous, step-by-step form of adjustment of conventional type, which will therefore not be described in greater detail.

Figure 3:
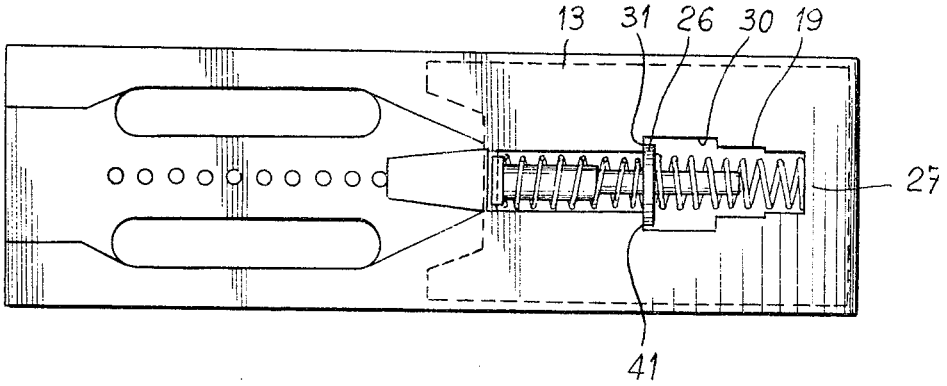
FIG. 3 is a view from below of the heel-piece in FIG. 2, showing, more particularly, the arrangement of the device according to the invention.

At the rear, as may be seen more particularly in FIG. 3, the baseplate has a housing generally marked 19, into which is inserted the recoil device according to the invention, the device consisting of a rod 20 which, in the example illustrated, is cylindrical.

The rod has an enlarged head 21 which is in contact, through a slot 22, with a curved part 23 of the casing 44 of the body of heel-piece 12. Rod 20 is surrounded by two springs 24, 25. One end of spring 24 bears against head 21 of the rod, while the other end thereof bears against a washer 26 sliding on rod 20 and located between springs 24, 25; as for spring 25, one end thereof bears against washer 26, while the other end bears against a cross member 27 of the baseplate.

It will be observed that end 28 of rod 20 is at a distance from cross member 27 of the baseplate, while between head 21 and end 28, the rod has a shoulder 29 designed as a support surface to carry washer 26 along when the load applied to the heel-piece reaches point *c* in FIG. 1.

However, it may be mentioned, as a variant, that the compression of spring 25 might start when spring 24 reaches the condition in which all of its coils are butted together. In this case, it would of course be possible to eliminate shoulder 29 on rod 20, since this is of use only if spring 24 does not reach the state in which its coils are butted together, which is a preferred arrangement.

As may be seen more particularly in FIG. 3, washer 26 bears against shoulders 31 on baseplate 13 and is guided, as it moves, in a recess 30 in housing 19. Shoulders 31 keep spring 25 suitably precompressed.

Figure 4:
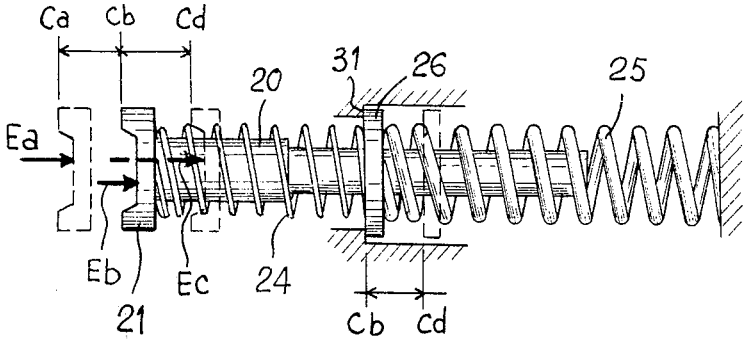
FIG. 4 is a diagram of the device according to the invention, to an enlarged scale, showing the three characteristic positions that the device may assume.

FIG. 4 is a diagrammatic representation of the operation of the recoil springs according to the invention, showing the three positions corresponding to the graph in FIG. 1.

Ca shows the normal position of the device at rest; Cb is the position it occupies after first spring 24 has been compressed by a load Eb. In this position, second spring 25 has not yet begun to be compressed, and shoulder 29 on rod 20 is in contact with washer 26 which remains against shoulder 31 of housing 30. This first operating phase corresponds to line 1 defined by points AB in the graph in FIG. 1. If the load applied to the heel-piece continues to increase, but remains less than Ec (see FIG. 1), there is no change in the position of the device.

On the other hand, as soon as the load becomes equal to Ec, spring 25 is compressed and head 21 on rod 20 moves from position Cb to position Cd; the same also applied to washer 26 which travels over the distance Cb–Cd. This compression corresponds to line 2 in FIG. 1.

Figure 5:
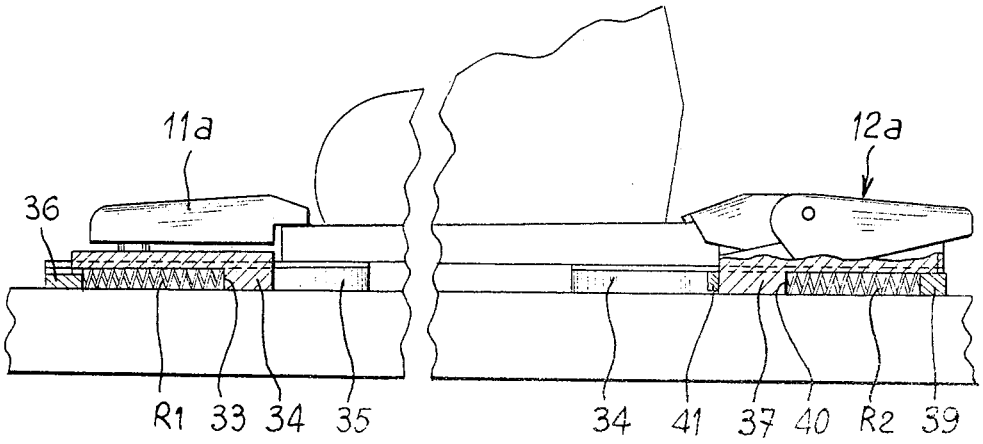
FIG. 5 is a sectional view of a variant of the invention, in which one of the springs is associated with the heel-piece and the other with the front stop, the heel-piece and stop being mounted so that they may move on the ski.

Finally, in the variant illustrated in FIG. 5, springs R1 and R2, which are still arranged in series, are connected respectively to front stop 11*a* and heel-piece 12*a*.

Spring R1, which, for example is weaker than spring R2, is located between a shoulder 33 on baseplate 34 of stop 11*a* which is arranged to move in slides 35 integral with the ski, and a transverse part 36 integral with slides 35.

As for heel-piece 12, this is carried on a baseplate 37 arranged to move in slides 38 secured to the ski, and spring R2 is located between a transverse part 39 on slide 38 and a shoulder 40 on baseplate 37.

The operation of this form of execution is identical with that described above, especially in connection with FIG. 1. In this present case, however, spring R1 must reach the butted-coils condition before R2 can be compressed. Moreover, in order that R2 may be prestressed, baseplate 37 must bear against a stop 41 integral with slide 38. A design of this kind produces the operation shown in the graph in FIG. 1, which characterizes the operation of bindings according to the invention.

What I claim is:

1. In a binding device having a base plate fixed to a ski and a binding assembly mounted on said base plate for maintaining a boot against said ski by its front and rear extremities, a method for absorbing without altering the characteristics of safety release, the parasitic stress caused, for example, by the flexion of the ski and acting between said boot and the binding assembly, said method comprising the steps of providing partly said binding assembly slidably movable on said base plate in the longitudinal direction of the ski, keeping at least one part of said partly slidably binding free to be displaced on said base plate against the action of a first resilient means for a first resilient displacement of said one part corresponding to a first series of load values, said first resilient means being interposed between said one part movable during said first resilient displacement and a stop part which is at least temporarily immobilized relative to said base plate during said first resilient displacement, temporarily immobilizing relative to said base plate said at least one part by means of the stop part for a second series of load values higher than the first series and keeping at least one part of said partly slidably binding free to be displaced on said base plate against the action of a second resilient means for a second resilient displacement of said one part corresponding to a third series of load values, said second resilient means being interposed between said one part of the binding movable during said second resilient displacement and a stop part which is immobilized relative to said base plate during said second resilient displacement.

2. In a binding device having a base plate fixed to a ski and a binding assembly mounted on said base plate for maintaining a boot against said ski by its front and rear extremities, said binding assembly being at least partly slidably movable on said base plate in the longitudinal direction of the ski; a device for absorbing the parasitic stress acting between the boot and the binding assembly and caused, for example, by the flexion of the ski, said device comprising:

a first resilient means permitting a first resilient displacement and being disposed between a part of said binding assembly movable during said first resilient displacement and a stop part which is at least temporarily immobilized relative to said base plate during said first resilient displacement of said movable part;

and at least a second resilient means permitting a second resilient displacement and disposed in series with said first resilient means, said second resilient means being interposed between part of said binding assembly movable during said second resilient displacement and a stop part which is immobilized relative to said base plate during said second resilient displacement.

3. In a binding device mounted on a ski and comprising:

a front stop fixed relative to the ski and maintaining the front extremity of a ski boot, a rear base plate fixed to the ski and equipped with slides, a heel piece slidably mounted on said slides of said base plate and maintaining the rear extremity of the ski boot, said heel-piece being able to slide on the base plate in the longitudinal direction of the ski, a device for absorbing the parasitic stress acting between the boot and the binding device and caused, for example, by the flexion of the ski, said device comprising a first resilient means, mounted longitudinally on the ski, one end of said first resilient means bearing against a portion of the slidable heel-piece while the other end bears against one end of a second resilient means, aligned, with the first, the free end of said second resilient means bearing against a portion of the base plate secured to the ski.

4. In a binding device mounted on a ski and comprising a front stop fixed relative to the ski and maintaining the front extremity of a ski boot, a rear base plate fixed to the ski and equipped with slides, a heel piece slidably mounted on said slides of said base plate and maintaining the rear extremity of the ski boot, said heel-piece being able to slide on the base plate in the longitudinal direction of the ski, a device for absorbing the parasitic stress acting between the boot and the binding device and caused, for example, by the flexion of the ski, said device comprising:

a first resilient means mounted longitudinally on the ski, one end of said first resilient means bearing against a portion of the slidable heel-piece while the other end bears against a second resilient means, aligned, with the first, the free end of said second resilient means bearing against a portion of the base plate secured to the ski; said other end further bearing against a stop plate located between said two resilient means, said stop plate being caused to bear against a recess in the base plate.

5. A device according to claim 4, wherein said base plate has guide means providing for the displacement of the stop-plate along the common axis of the resilient means.

6. In a binding device mounted on a ski and comprising:

a front base plate fixed to the ski and equipped with slides, a front stop slidably mounted on the slides of said front base plate and maintaining the front extremity of the ski-boot, a rear base plate fixed to the ski and equipped with slides, a heel-piece slidably mounted on the slides of said rear base plate and maintaining the rear extremity of the ski boot, a device for absorbing the parasitic stress acting between the boot and the binding device and caused, for example, by the flexion of the ski, said device comprising:

a first resilient means mounted longitudinally on the ski, one end of said first resilient means bearing against a portion of the slidable front stop while the other end bears against a fixed part of the front base plate, and a second resilient means mounted longitudinally on the ski, one end of said second resilient means bearing against a portion of the slidable heel-piece while the other end bears against a fixed part of the rear base plate.

7. A device according to claim 2, wherein the two resilient means are compression springs.

8. A device according to claim 7, wherein the two springs are arranged substantially parallel in the longitudinal direction of the ski.

9. A device according to claim 8, wherein the two springs are aligned along a common axis.

10. A device according to claim 7, wherein the two springs have different mechanical characteristics, the first spring being weaker than the second.

11. A device according to claim 7, wherein the two springs are identical.

12. A device according to claim 10, wherein the first spring is kept in a precompressed condition in the normal position of the binding.

13. A device according to claim 4, wherein said resilient means are compression springs which are aligned along a common axis; a rod being engaged along the axis of the two springs, one end of said rod being provided with an enlarged head against which the first spring bears, whereas the free face of the head itself is in contact with a part of the heel-piece.

14. A device according to claim 13, wherein the stop-plate is a washer, said rod being arranged to slide in the washer and being provided with a shoulder which carries said washer along and causes the second spring to compress when the first spring is compressed to a predetermined value.

15. A device according to claim 6, wherein said resilient means are compression springs; the spring cooperating with the heel-piece being prestressed by means of a stop integral with the slides of the rear base plate.

* * * * *